US011155954B2

(12) United States Patent
Scheckelhoff et al.

(10) Patent No.: US 11,155,954 B2
(45) Date of Patent: Oct. 26, 2021

(54) WATER LEVEL DETECTION SYSTEM FOR A WASHING MACHINE APPLIANCE AND METHODS FOR OPERATING THE SAME

(71) Applicant: Haier US Appliance Solutions, Inc., Wilmington, DE (US)

(72) Inventors: Ryan James Scheckelhoff, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 85 days.

(21) Appl. No.: 16/594,303

(22) Filed: Oct. 7, 2019

(65) Prior Publication Data

US 2021/0102332 A1 Apr. 8, 2021

(51) Int. Cl.
*D06F 39/08* (2006.01)
*D06F 33/00* (2020.01)

(52) U.S. Cl.
CPC ..... *D06F 39/087* (2013.01); *D06F 33/00* (2013.01); *D06F 39/082* (2013.01); *D06F 2202/085* (2013.01)

(58) Field of Classification Search
CPC .... D06F 39/082; D06F 39/083; D06F 39/087; D06F 33/00; D06F 33/34; D06F 33/47; D06F 33/42; D06F 2202/085
USPC ..... 68/21.21
See application file for complete search history.

(56) References Cited

U.S. PATENT DOCUMENTS 3,986,372 A * 10/1976 Karklys ..... D06F 39/081 68/12.21
6,125,870 A 10/2000 Furmanek
2008/0011339 A1* 1/2008 Ryu ..... A47L 15/4217 134/56 D
2016/0369443 A1* 12/2016 Kim ..... D06F 39/10

FOREIGN PATENT DOCUMENTS

CN 109056270 A 12/2018
KR 200150324 Y1 7/1999

* cited by examiner

*Primary Examiner* — Tinsae B Ayalew
(74) *Attorney, Agent, or Firm* — Dority & Manning, P.A.

(57) ABSTRACT

A washing machine appliance includes a sump for collecting wash fluid, a water supply valve for supplying wash fluid during a fill cycle, and a drain pump assembly for draining that wash fluid during a drain cycle. A controller is configured for monitoring the sump pressure using a water level detection system, detecting a fill sensing failure such as a slow pressure rise after the fill cycle, detecting a drain sensing failure such as a slow pressure drop during the drain cycle, and determining that the water level detection system is malfunctioning if the fill sensing failure and the drain sensing failure are detected.

20 Claims, 7 Drawing Sheets

WATER LEVEL DETECTION SYSTEM FOR A WASHING MACHINE APPLIANCE AND METHODS FOR OPERATING THE SAME

FIELD OF THE INVENTION

The present subject matter relates generally to washing machine appliances, or more specifically, to accurate water level detection within washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances may include water level detection systems for detecting the amount of water dispensed into the tub in during a fill cycle or the amount of water remaining within the sump after a drain cycle. For example, water level detection systems may include pressure sensors coupled to pressure hoses on the sump for detecting the water pressure for determining the water level. Such systems can use this information to detect fill or drainage issues, such as a drain pump failure, and to ensure the ideal amount of water is in the tub for performing a particular wash cycle. However, in certain situations, the pressure sensor may become partially blocked, resulting in erroneous pressure readings and/or a delayed response. Failure to compensate for such variations in pressure readings can result in overfilling or underfilling the tub.

Accordingly, a washing machine appliance having improved features for determining the water level in the sump would be desirable. More specifically, a washing machine appliance with an improved water level detection system would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a sump for collecting wash fluid, a fluid supply valve for supplying the wash fluid during a fill cycle, and a drain pump assembly in fluid communication with the sump for selectively draining the wash fluid collected within the sump during a drain cycle. A water level detection system includes an air chamber fluidly coupled to the sump and a pressure sensor and a controller operably coupled to the fluid supply valve, the drain pump assembly, and the water level detection system. The controller is configured for monitoring a sump pressure using the water level detection system, detecting a fill sensing failure at the end of the fill cycle, detecting a drain sensing failure during the drain cycle, and determining that the water level detection system is malfunctioning if the fill sensing failure and the drain sensing failure are detected.

In accordance with another exemplary embodiment of the present disclosure, a method for operating a washing machine appliance is provided. The washing machine appliance includes a sump for collecting wash fluid, a water level detection system for measuring a sump pressure, a fluid supply valve for providing a flow of wash fluid during a fill cycle, and a drain pump assembly for discharging the flow of wash fluid during a drain cycle. The method includes monitoring a sump pressure using the water level detection system, detecting a fill sensing failure at the end of the fill cycle, detecting a drain sensing failure during the drain cycle, and determining that the water level detection system is malfunctioning if the fill sensing failure and the drain sensing failure are detected.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
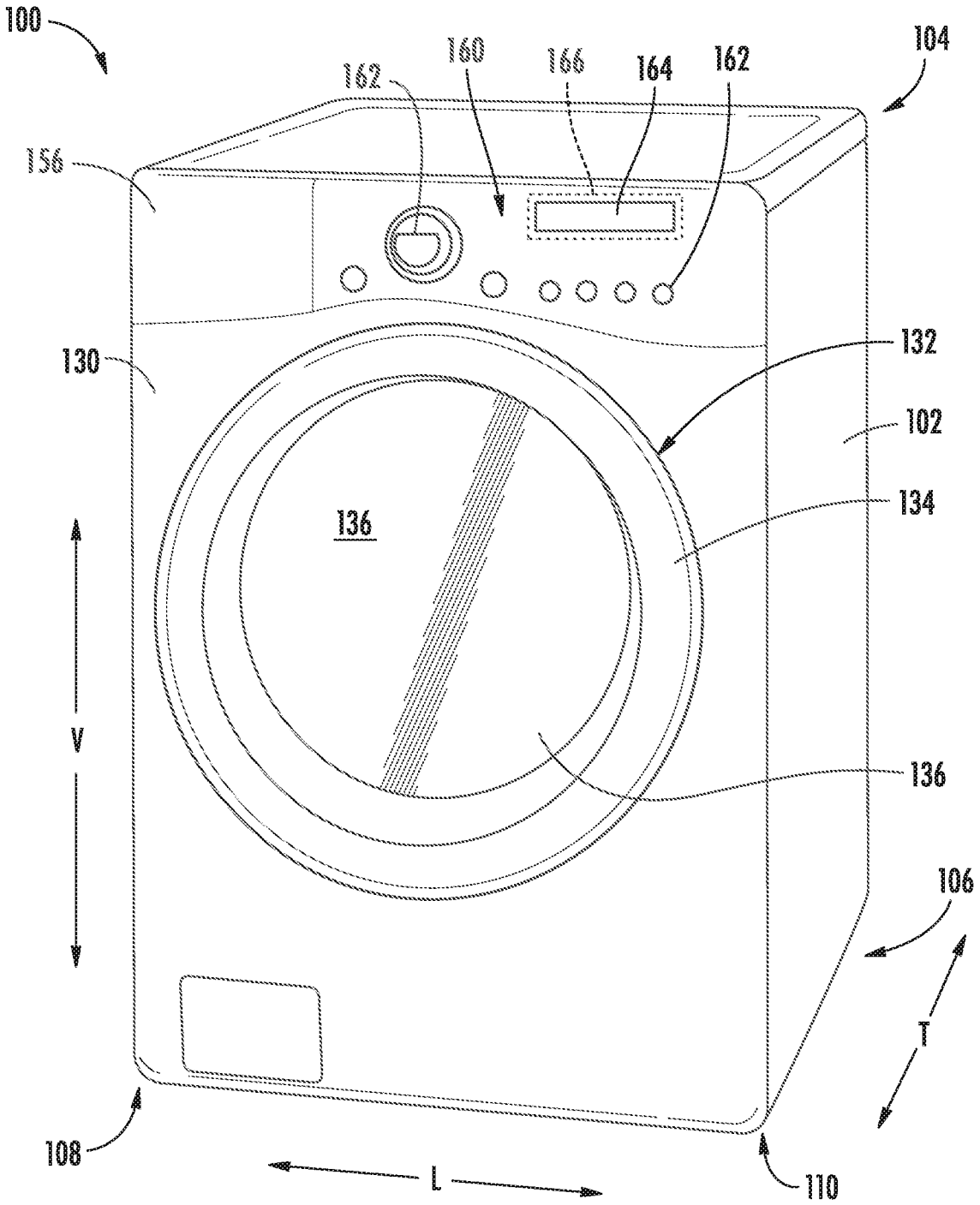
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
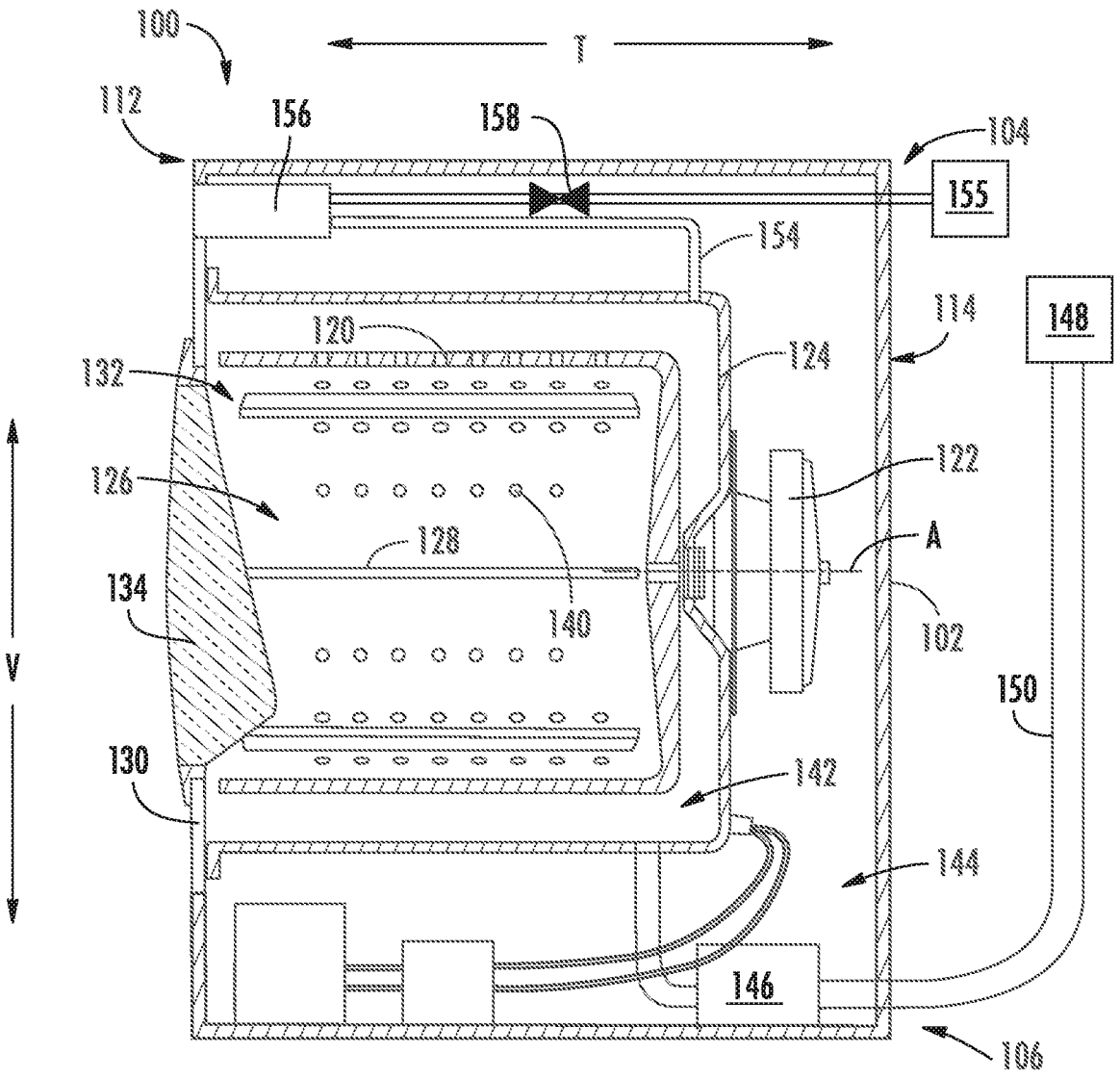
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into wash tub 124. For example, spout 154 may be in fluid communication with a water supply 155 (FIG. 2) in order to direct fluid (e.g., clean water or wash fluid) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 156 may also be fluidly coupled to spout 154 to facilitate the complete and accurate dispensing of wash additive.

In addition, a water supply valve 158 may provide a flow of water from a water supply source (such as a municipal water supply 155) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Figure 3:
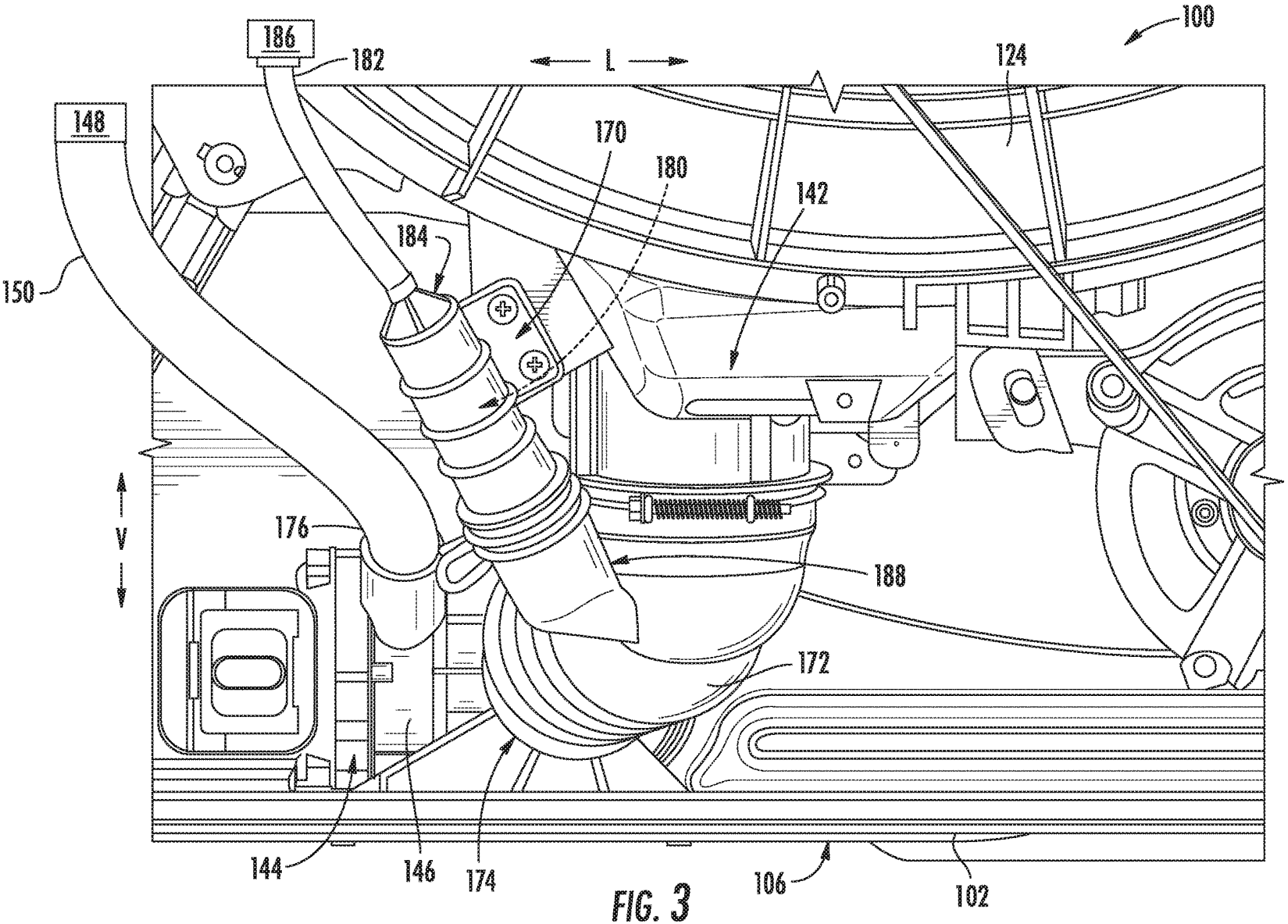
FIG. 3 provides a rear, perspective view of a drain pump assembly and a water level detection system according to an exemplary embodiment of the present subject matter.
Figure 4:
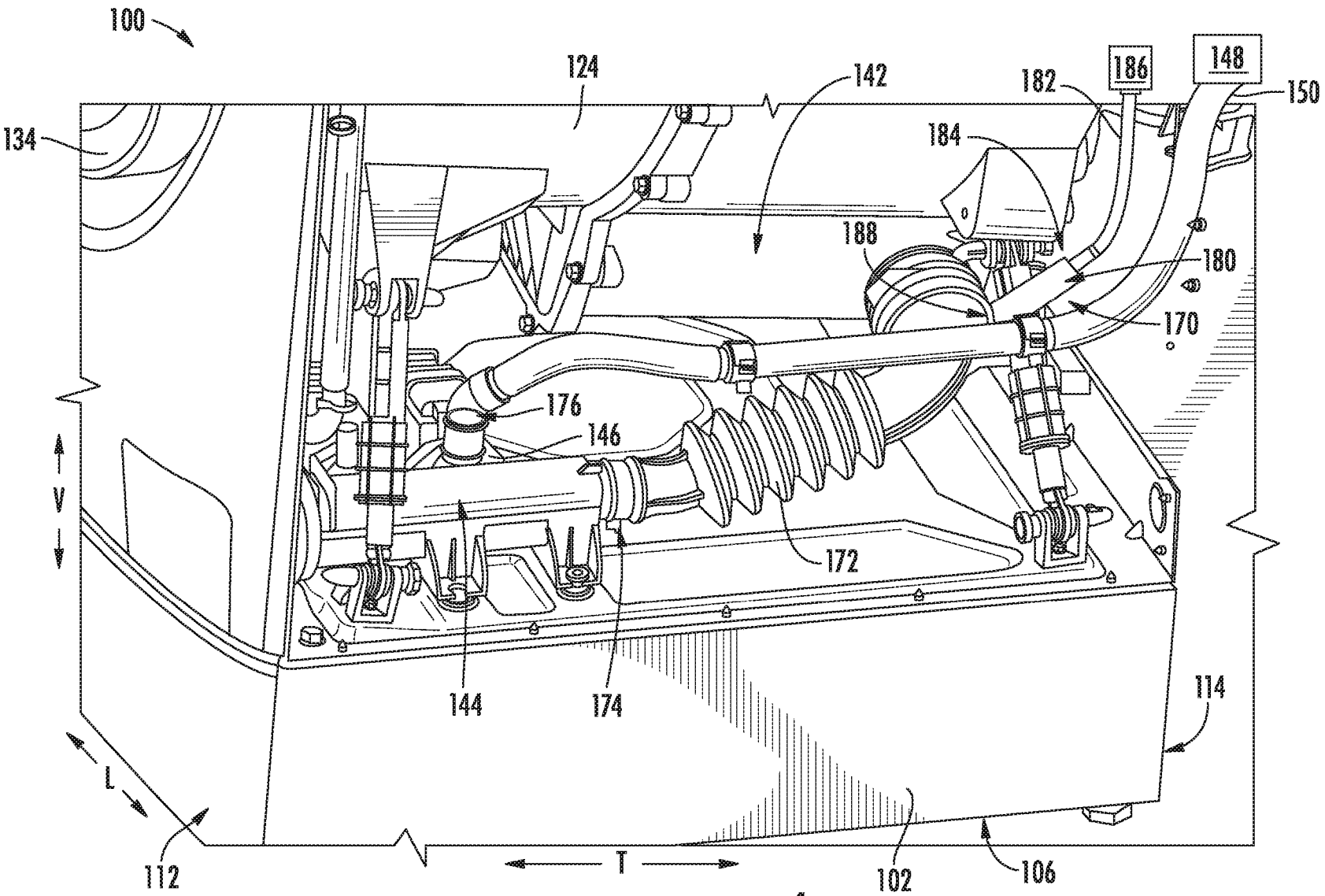
FIG. 4 provides a side, perspective view of the exemplary drain pump assembly and water level detection system of FIG. 3.

Referring now to FIGS. 3 and 4, a water level detection system 170 that may be used within washing machine appliance 100 will be described according to an exemplary embodiment. Specifically, FIGS. 3 and 4 provide rear perspective and side perspective views, respectively, of water level detection system 170 operably coupled to a drain pump assembly (e.g., drain pump assembly 144). However, water level detection system 170 as described herein is only one exemplary configuration used for the purpose of explaining aspects of the present subject matter and is not intended to limit the scope of the invention in any manner.

As illustrated, sump 142 defines a drain basin at a lowest point of wash tub 124 for collecting wash fluid under the force of gravity. A sump hose 172 extends between sump 142 and an intake 174 of drain pump 146. According to the illustrated embodiment, drain pump 146 is a positive displacement pump configured for urging wash fluid that collects in sump 142 and sump hose 172 through a pump discharge 176, through drain hose 150, and to external drain 148. However, it should be appreciated that the drain pump assembly 144 and the sump drainage configuration illustrated herein are only exemplary and not intended to limit the scope of the present subject matter. For example, drain pump 146 may have a different configuration or position, may include one or more filtering mechanisms, etc.

Water level detection system 170 may generally include an air chamber 180 that extends from sump hose 172 (or another suitable portion of sump 142) at least partially upward along the vertical direction V. A pressure hose 182 is fluidly coupled to a top end 184 of air chamber 180 and extends to a pressure sensor 186. In general, pressure sensor 186 may be any sensor suitable for determining a water level within sump 142 based on pressure readings. For example, pressure sensor 186 may be a piezoelectric pressure sensor and thus may include an elastically deformable plate and a piezoresistor mounted on the elastically deformable plate. According to exemplary embodiments, pressure sensor 186 is positioned proximate top 104 of cabinet 102, e.g., proximate or mounted to control panel 160. Thus, pressure hose 182 extends from air chamber 180 (i.e., proximate bottom 106 of cabinet 102) upward along the vertical direction V to pressure sensor 186.

Water level detection system 170 and pressure sensor 186 generally operate by measuring a pressure of air within air chamber 180 and using the measured chamber pressure to estimate the water level in sump 142. For example, when the water level within sump 142 falls below a chamber inlet 188, the pressure within air chamber 180 normalizes to ambient or atmospheric pressure, and thus reads a zero pressure. However, when water is present in sump 142 and rises above chamber inlet 188, the measured air pressure becomes positive and may increase proportionally with the water level. Although sump 142 is described herein as containing water, it should be appreciated that aspects of the present subject matter may be used for detecting the level of any other suitable wash fluid.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 5:
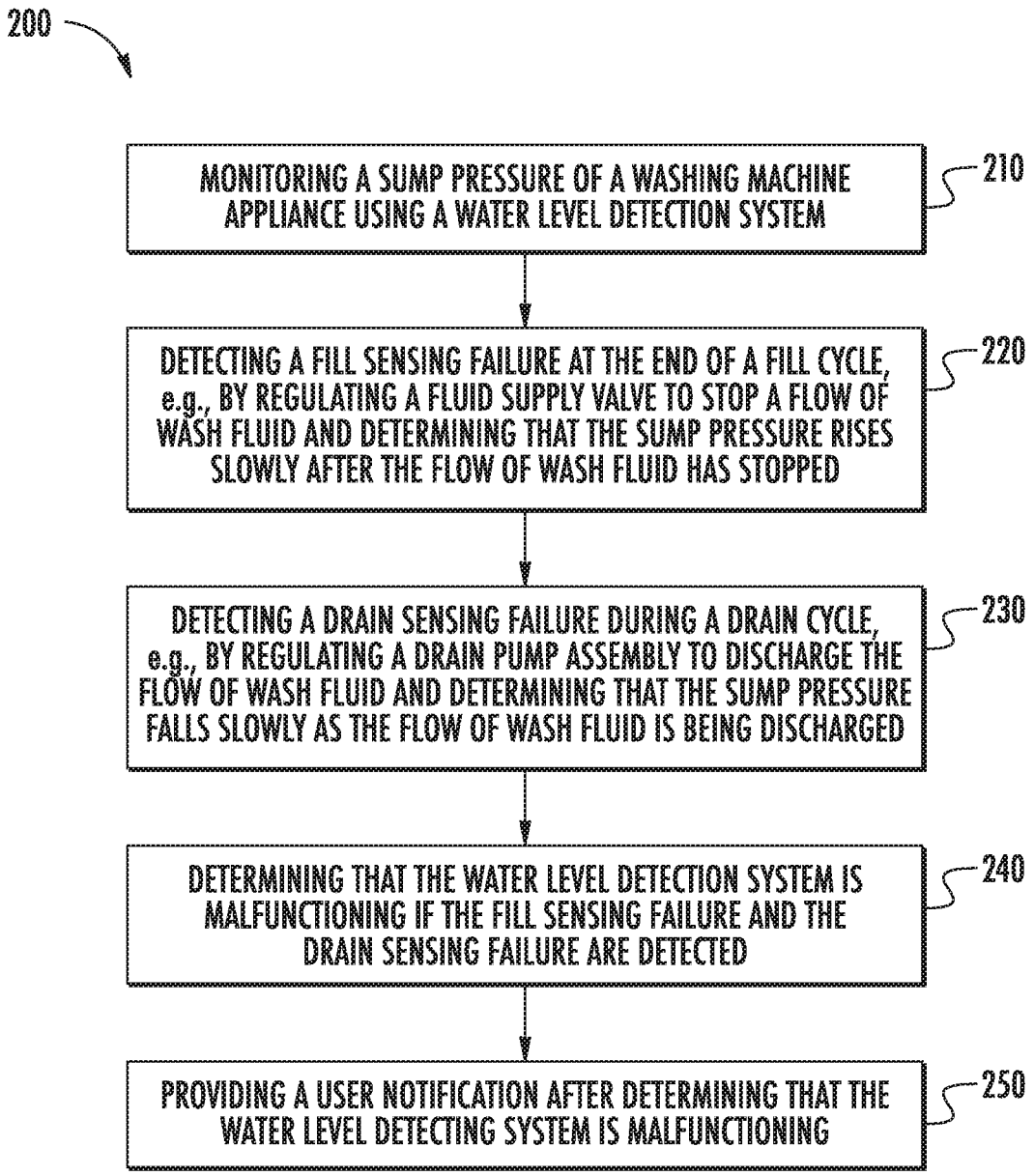
FIG. 5 illustrates a method for controlling a washing machine appliance in accordance with one embodiment of the present disclosure.

Referring now to FIG. 5, method 200 includes, at step 210, monitoring a sump pressure of a washing machine appliance using a water level detection system. Specifically, continuing example from above, water level detection system 170 may be used to continuously monitor a sump pressure within sump 142 of washing machine appliance 100. Notably, in certain situations, water level detection system 170 may become clogged or partially clogged such that sump pressure measurements are inaccurate. For example, if pressure hose 182 or air chamber 180 is clogged or partially clogged, the readings of pressure sensor 186 may lag behind the actual pressures within sump 142. In this regard, during a fill cycle, the measured sump pressure may be lower than the actual sump pressure. Similarly, during a drain cycle, the measured sump pressure may remain higher than the actual sump pressure. Notably, such erroneous pressure readings may result in overfilling and/or underfilling sump 142, may result in partial discharge of wash fluid within sump during a drain cycle, or may otherwise negatively affect the performance of washing machine appliance 100.

Figure 6:
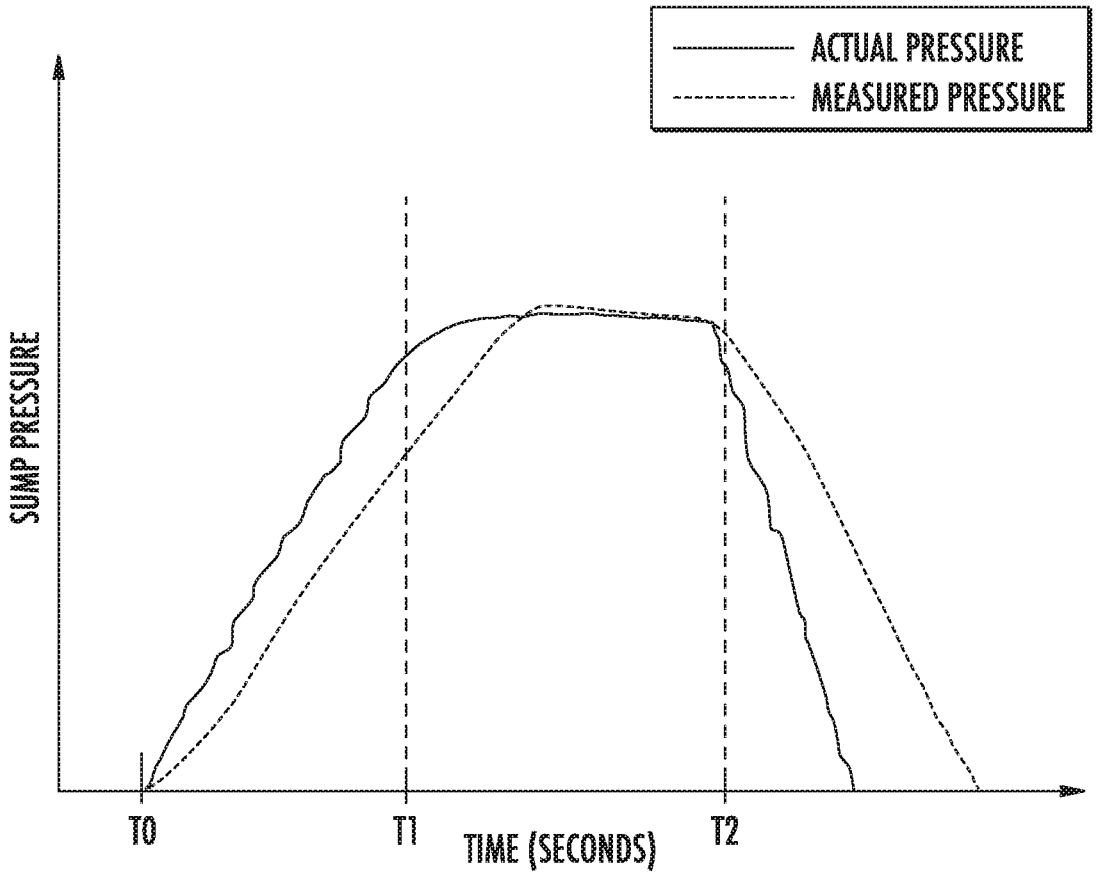
FIG. 6 provides a plot of pressure measurements from a pressure sensor of the exemplary washing machine appliance of FIG. 1 over time.

More specifically, referring briefly to FIG. 6, an exemplary plot of pressure measurement signals from pressure sensor 186 and actual sump pressures over an exemplary fill cycle and drain cycle is provided. As illustrated, a fill cycle commences at fill start time (T0). Specifically, at time T0, water supply valve 158 opens to begin providing a flow of wash fluid through spout 154 and into sump 142. The fill process may continue until controller 166 determines that the target wash fluid level has been achieved. According to exemplary embodiments, controller 166 may determine the wash fluid level using a time-based determination (e.g., estimating volume based on the time the water valve is open multiplied by an average flow rate), a pressure-based determination (e.g., using water level detection system 170), or may be determined in any other suitable manner. According to the illustrated embodiment, controller 166 shuts water supply valve 158 at a valve shutoff time (T1).

Notably, as shown in FIG. 6, the measured pressure is shown in dotted lines and the actual pressure is shown in solid lines. Specifically, this exemplary plot illustrates that effects of a partially clogged water level detection system 170. In this regard, the measured sump pressures may lag behind the actual pressure, resulting in a number of operational issues as described herein. Thus, after the controller 166 has shut off water supply valve 158 (e.g., at T1) the measured sump pressure continues to rise slowly until the steady-state sump pressure is reached (i.e., the plateau shown in FIG. 6 between the fill and drain cycles, e.g., between T1 and T2.

A wash or rinse cycle may be performed when sump 142 has been filled with wash fluid, e.g., between the valve shutoff time (T1) and a drain start time (T2). Specifically, as shown, drain pump 146 may be started at time T2 and wash fluid may be discharged from sump 142 at a steady rate. However, in the event of a clogged or partially clogged water level detection system 170, the measured sump pressure once again lags the actual sump pressure. In this regard, a magnitude of the slope of the measured pressure is smaller than a magnitude of the actual pressure after time T2. Notably aspects of the present subject matter, and particularly the method steps described below, are intended to use the relationship between actual and measured sump pressures to determine when water level detection system 170 is clogged or partially clogged.

Referring again to FIG. 5, method 200 further includes, at step 220, detecting a fill sensing failure at the end of a fill cycle. As used herein, the "fill cycle" is generally intended to refer to the time that water supply valve 158 is open such that wash fluid is being added to sump 142. In addition, the "fill sensing failure" is generally intended to refer to a condition where the water level detection system 170 is not accurately measuring the sump pressure during the fill cycle. For example, if the sump pressure measurements lag behind the actual sump pressure by some threshold amount, this may indicate a fill sensing failure. This failure mode may be measured based on absolute differences between the actual and measure pressures, based on the slope of the actual and measured pressure over time, based on an integration of the actual or measured pressures, based on the time it takes the measured pressures to normalize after the water supply valve 158 is shut off, or based on any other suitable quantifiable factor and/or calculation. Controller 166 may have an internal flag or parameter that is set when the fill sensing failure has occurred and may be cleared if no fill sensing failure has occurred.

Thus, according to an exemplary embodiment, a fill sensing failure may be detected when controller 166 regulates the water supply valve 158 to stop providing a flow of wash fluid and determines that the sump pressure rises slowly after the flow of wash fluid has stopped. In this regard, as explained above, if controller 166 knows that fluid supply valve 158 has been closed and determines that the measured sump pressure is still increasing after that valve 158 has been closed, controller 166 may trigger a first flag or make a first determination that there has been a fill sensing failure. As explained below, controller may determine that water level detection system 170 is malfunctioning if both the fill sensing failure flag has been triggered and the drain sensing failure flag has been triggered.

As described above, the fill sensing failure may be triggered when the sump pressure rises after water supply valve 158 is closed. However, according to an exemplary embodiment, controller 166 may determine that a fill sensing failure has occurred by monitoring a fill pressure slope after the fill cycle has stopped. In this regard, controller 166 may measure the sump pressure over a predetermined time period after water supply valve 158 is closed, e.g., at T1. For example, controller 166 may monitor sump pressure for a time period between about 0.1 and 2 seconds, between about 0.2 and 1.5 seconds, between about 0.25 and 1 second, or for about 0.5 seconds, after the fill cycle is finished. Controller 166 may then take an average slope of the measured sump pressure over that time period and may determine that the sump pressure is rising slowly or that a fill sensing failure should be triggered if the fill pressure slope is greater than a predetermined fill pressure slope. According to exemplary embodiments, the predetermined fill pressure slope be set by a user, set by the manufacturer, or may be determined in any other suitable manner.

According to exemplary embodiments, the fill pressure slope should be zero or near zero after the fill process is stopped, e.g., when water supply valve 158 is closed at T1. Thus, any substantial positive slope above a predetermined slope after an elapsed time from T1 could be considered a fill failure. Therefore, according to one exemplary embodiment, a time delay could be implemented after the water supply valve 158 is closed at T1, e.g., to account for time required by the fill system to finish adding water. After that time delay, the fill pressure slope measurement may be performed and a slope greater than some predetermined fill pressure slope should trigger the fill sensing failure. It should be appreciated that the time delay, the predetermined slopes, and other fill sensing factors may be used to determine whether a fill sensing failure has occurred.

According to still other embodiments, controller 166 may simply determine that the measured sump pressure is still changing after a predetermined amount of time is lapsed since the flow of wash fluid stopped, e.g., as measured by the closing of water supply valve 158. In this regard, at the closing of water supply valve 158 (e.g., at T1), controller 166 may initiate a timer. When that timer reaches a predetermined amount of time (e.g., 0.5 seconds, 1 second, 5 seconds, etc.), controller 166 will make a determination as to whether the measured sump pressure is constant or is still changing. If the measured sump pressure is still changing, controller 166 may trigger the fill sensing failure condition, e.g., indicating that the measured pressures from the water level detection system 170 are still trying to catch up to the actual sump pressures.

Notably, the condition where the measured sump pressures lag behind the actual sump pressures might not in every circumstance be due to a partially blocked water level detection system 170. For example, a faulty water supply valve 158 may inadvertently supply additional water after shutoff, thereby increasing the sump pressures after controller 166 initiates the shutoff process. For example, this may be due to valve hardware issues, valve wear, worn valve seals, etc. Therefore, method 200 may include additional steps to verify that the issues are in fact due to a partially blocked water level detection system 170.

Specifically, step 230 may include detecting a drain sensing failure during a draining cycle. As used herein, the "drain cycle" is generally intended to refer to the time during which drain pump 146 is operating to discharge wash fluid from sump 142 (e.g., after T2 in FIG. 6). In addition, the "drain sensing failure" is generally intended to refer to a condition where the water level detection system 170 is not accurately measuring the sump pressure during the drain cycle.

In this regard, at time T2, controller 166 may instruct drain pump 146 to begin discharging wash fluid from sump 142. As shown in FIG. 6, drain pump 146 is effective at quickly discharging wash fluid from sump 142 and lowering the actual sump pressures therein (e.g., as shown in solid lines). However, as explained above, a partially blocked water level detection system 170 may result in measured sump pressures that lag behind the actual sump pressures (e.g., as shown in dotted lines). Thus, controller 166 may trigger or otherwise determine that a drain sensing failure when the drain pump assembly is operating to discharge flow of wash fluid, but the sump pressure is falling slower than expected.

More specifically, for example, controller 166 may obtain a drain pressure slope of the sump pressure over a period of time during the draining cycle. Thus, during all or a portion of the time during which drain pump 146 is on, controller 166 may monitor the sump pressure and may determine an average slope of the pressure drop measured by water level detection system 170. If controller 166 determines that the drain pressure slope is lower in magnitude than a predetermined drain pressure slope, the drain sensing failure may be triggered. Similar to the predetermined fill pressure slope, the predetermined drain pressure slope may be determined in any suitable manner, e.g., may be set by a manufacturer to help identify a faulty water level detection system 170. In addition, controller 166 may include a drain sensing failure flag that is triggered to help track this failure state.

Notably, as explained above, if both the fill sensing failure and the drain sensing failure conditions are triggered, this is a strong indication of a partially blocked water level detection system 170. For example, if only the drain sensing failure is detected, this condition may be indicative of an inefficient or malfunctioning drain pump 146 and does not necessarily indicate a clogged water level detection system 170. Thus, step 240 includes determining that the water level detection system is malfunctioning if the fill sensing failure and the drain sensing failure are detected.

According to exemplary embodiments, method 200 may further include steps of determining that there is no fill sensing failure or no drain sensing failure. In this manner, if controller 166 only determines that only one of the fill sensing failure or drain sensing failures are triggered, controller 166 may determine that the problem does not relate to the water level detection system 170. For example, method 200 may include determining that there is no sensing failure if the fill pressure slope of the sump pressure over time in measured after the fill cycle is less than a predetermined fill pressure slope. In addition, or alternatively, method 200 may include determining that there is no drain sensing failure if drain pressure slope of the sump pressure over time during the drain cycle is greater than a predetermined drain pressure slope. According to still other embodiments, a drain sensing failure may be based on a simple drain timeout, e.g., such that a drain sensing failure is triggered unless the pressure reaches zero within a predetermined time, such as 5 seconds, 15 seconds, 30 seconds, 1 minutes, 2 minutes, or any other suitable time period.

Method 200 may further include, at step 250, providing a user notification after determining that the water level detection system is malfunctioning. For example, the user notification may be provided via display 164, via communication with an external device, or in any other suitable manner. In addition, the user notification may include a recommendation to schedule a service call, order a new part, or perform other corrective action.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

Figure 7:
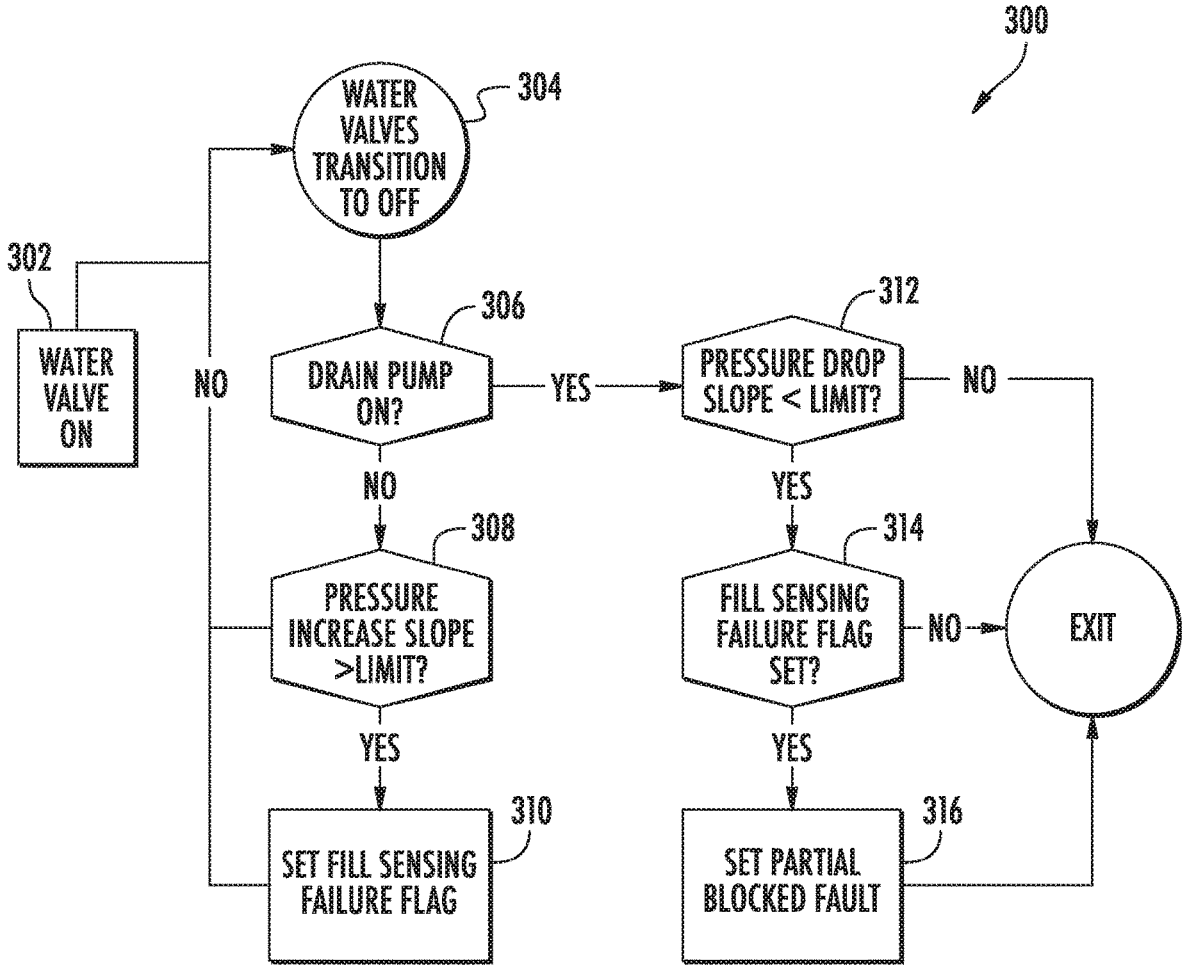
FIG. 7 illustrates an exemplary decision tree or flow diagram of an operating method of the washing machine appliance of FIG. 1 according to an exemplary embodiment of the present subject matter.

Referring now to FIG. 7, an exemplary illustration of the decision making process or control method implemented by controller 166 to perform method 200 is illustrated. It should be appreciated that the flow diagram 300 is intended only to provide a simple illustration of an exemplary control method. The flow diagram 300 is not intended to limit the scope of the present subject matter in any manner.

As shown, flow diagram 300 may begin on left side at 302, where the water valves are turned on to initiate a fill cycle (e.g., corresponding to time T0 in FIG. 6). The logic in flow diagram 300 may be repeated continuously until the end of the washing machine operating cycle. At step 304, the water valves are turned off (e.g., corresponding to time T1 in FIG. 6) such that the flow of water or wash fluid stops flowing into the sump. At step 306, the appliance controller makes a determination as to whether the drain pump is on. If it is not, step 308 includes determining the slope of the measured sump pressure and comparing that measured slope to a predetermined threshold fill pressure slope. If the measured slope is greater than the predetermined threshold fill pressure slope, a fill sensing failure flag may be triggered at 310.

Flow diagram 300 may continue until the drain pump is turned on, e.g., as determined at step 306. At step 312, the controller may monitor the pressure drop measured by the water level detection system during the drain cycle. Specifically, a slope of the measured pressure drop may be compared to a predetermined drain pressure slope. If the measured pressure drop slope is lower in magnitude than the predetermined drain pressure slope, flow diagram 314 may proceed to step 314. At step 314, the controller determines whether the fill sensing failure flag was set in step 310. If it was, controller may determine at step 316 that a malfunction of the water level detection system has occurred, e.g., potentially indicating a partially clogged pressure hose 182. It should be appreciated that modifications and variations may be made to method 200 and flow diagram 300 while remaining within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a sump for collecting wash fluid;

a fluid supply valve for supplying the wash fluid during a fill cycle;

a drain pump assembly in fluid communication with the sump for selectively draining the wash fluid collected within the sump during a drain cycle, wherein the drain cycle and the fill cycle occur during a single operating cycle of the washing machine appliance;

a water level detection system comprising an air chamber fluidly coupled to the sump and a pressure sensor; and a controller operably coupled to the fluid supply valve, the drain pump assembly, and the water level detection system, the controller being configured for:

monitoring a sump pressure using the water level detection system;

detecting a fill sensing failure at the end of the fill cycle;

detecting a drain sensing failure during the drain cycle; and determining that the water level detection system is malfunctioning if the fill sensing failure and the drain sensing failure are detected.

2. The washing machine appliance of claim 1, wherein detecting the fill sensing failure comprises:

regulating the fluid supply valve to stop a flow of wash fluid; and determining that the sump pressure rises after the flow of wash fluid has stopped.

3. The washing machine appliance of claim 2, wherein determining that the sump pressure rises after the flow of wash fluid has stopped comprises:

obtaining a fill pressure slope of the sump pressure over time after the fill cycle; and determining that the fill pressure slope is greater than a predetermined fill pressure slope.

4. The washing machine appliance of claim 3, wherein the fill pressure slope is measured as an average slope over a predetermined time period.

5. The washing machine appliance of claim 2, wherein determining that the sump pressure rises slowly after the flow of wash fluid has stopped comprises:

determining that the sump pressure is still changing after a predetermined amount of time has lapsed since stopping the flow of wash fluid.

6. The washing machine appliance of claim 1, wherein detecting the drain sensing failure comprises:

regulating the drain pump assembly to discharge a flow of wash fluid; and determining that the sump pressure falls at less than a predetermined drain pressure slope as the flow of wash fluid is being discharged.

7. The washing machine appliance of claim 6, wherein determining that the sump pressure falls at less than the predetermined drain pressure slope as the flow of wash fluid is being discharged comprises:

obtaining a drain pressure slope of the sump pressure over time during the drain cycle; and determining that the drain pressure slope is lower than the predetermined drain pressure slope.

8. The washing machine appliance of claim 1, wherein the controller is further configured for:

providing a user notification after determining that the water level detection system is malfunctioning.

9. The washing machine appliance of claim 1, wherein the controller is further configured for:

determining that there is no fill sensing failure if a fill pressure slope of the sump pressure over time after the fill cycle is less than a predetermined fill pressure slope.

10. The washing machine appliance of claim 1, wherein the controller is further configured for:

determining that there is no drain sensing failure if a drain pressure slope of the sump pressure over time during the drain cycle is greater than a predetermined drain pressure slope.

11. A method for operating a washing machine appliance, the washing machine appliance comprising a sump for collecting wash fluid, a water level detection system for measuring a sump pressure, a fluid supply valve for providing a flow of wash fluid during a fill cycle, and a drain pump assembly for discharging the flow of wash fluid during a drain cycle, the method comprising:

monitoring a sump pressure using the water level detection system;

detecting a fill sensing failure at the end of the fill cycle;

detecting a drain sensing failure during the drain cycle, wherein the drain cycle and the fill cycle occur during a single operating cycle of the washing machine appliance; and determining that the water level detection system is malfunctioning if the fill sensing failure and the drain sensing failure are detected.

12. The method of claim 11, wherein detecting the fill sensing failure comprises:

regulating the fluid supply valve to stop the flow of wash fluid; and determining that the sump pressure rises after the flow of wash fluid has stopped.

13. The method of claim 12, wherein determining that the sump pressure rises after the flow of wash fluid has stopped comprises:

obtaining a fill pressure slope of the sump pressure over time after the fill cycle; and determining that the fill pressure slope is greater than a predetermined fill pressure slope.

14. The method of claim 13, wherein the fill pressure slope is measured as an average slope over a time period between about 0.25 and 1 seconds.

15. The method of claim 12, wherein determining that the sump pressure rises after the flow of wash fluid has stopped comprises:

determining that the sump pressure is still changing after a predetermined amount of time has lapsed since stopping the flow of wash fluid.

16. The method of claim 11, wherein detecting the drain sensing failure comprises:

regulating the drain pump assembly to discharge a flow of wash fluid; and determining that the sump pressure falls at less than a predetermined drain pressure slope as the flow of wash fluid is being discharged.

17. The method of claim 16, wherein determining that the sump pressure falls at less than the predetermined drain pressure slope as the flow of wash fluid is being discharged comprises:

obtaining a drain pressure slope of the sump pressure over time during the drain cycle; and determining that the drain pressure slope is lower than the predetermined drain pressure slope.

18. The method of claim 11, further comprising:

providing a user notification after determining that the water level detection system is malfunctioning.

19. The method of claim 11, further comprising:

determining that there is no fill sensing failure if a fill pressure slope of the sump pressure over time after the fill cycle is less than a predetermined fill pressure slope.

20. The method of claim 11, further comprising:

determining that there is no drain sensing failure if a drain pressure slope of the sump pressure over time during the drain cycle is greater than a predetermined drain pressure slope.

* * * * *